United States Patent [19]

Elmore et al.

[11] 4,164,890

[45] Aug. 21, 1979

[54] LIQUID PROPELLANT MODULAR GUN INCORPORATING DUAL CAM OPERATION AND INTERNAL WATER COOLING

[75] Inventors: Lester C. Elmore, Portola Valley, Calif.; Thomas M. Broxholm, deceased, late of Palo Alto, Calif., by Anne K. Broxholm, administratrix

[73] Assignee: Pulsepower Systems, Inc., San Carlos, Calif.

[21] Appl. No.: 834,688

[22] Filed: Sep. 19, 1977

Related U.S. Application Data

[62] Division of Ser. No. 616,822, Sep. 25, 1975, Pat. No. 4,062,266.

[51] Int. Cl.[2] ..... F41D 3/06; F41F 11/00

[52] U.S. Cl. ..... 89/185; 89/7; 89/11

[58] Field of Search ..... 89/7, 11, 12, 185

[56] References Cited

U.S. PATENT DOCUMENTS

| | | | |
|---|---|---|---|
| 3,071,043 | 1/1963 | McThomas | 89/12 |
| 3,241,448 | 3/1966 | Rocha | 89/9 UX |
| 3,648,561 | 3/1972 | Stoner | 89/11 |
| 3,722,356 | 3/1973 | Tassie et al. | 89/11 |
| 3,800,657 | 4/1974 | Broxholm et al. | 89/7 |
| 3,868,884 | 3/1975 | Rose et al. | 89/11 |
| 4,011,790 | 3/1977 | Folsom et al. | 89/172 X |

*Primary Examiner*—David H. Brown

*Attorney, Agent, or Firm*—Donald C. Feix

[57] ABSTRACT

A liquid propellant modular gun has a slim profile and is constructed for wide latitude in gun cluster configuration.

The modular gun has a stationary barrel and is externally driven and cam operated by a drive cam and a control cam.

The drive cam has one internal spiral cam track for driving the bolt forward to a projectile firing position and another internal spiral cam track for driving the bolt rearward to a projectile loading position.

The control cam is mounted for rotation at the forward end of the drive cam and controls the injection of liquid propellant into the combustion chamber and an electrical igniter.

A water injection mechanism is also associated with the control cam for injecting a small amount of water into the combustion chamber after the firing of each round to cool the combustion chamber structure by internal water cooling. The water injection mechanism is also effective to purge propellant from the combustion chamber in the event of a misfire.

The bolt is rotated to a locked position at the forward end of its travel where locking lugs on the bolt are engaged with mating lugs on the barrel so that all breach loads caused by chamber pressure are carried through the barrel rather than the receiver. This permits the receiver to be made quite light.

5 Claims, 44 Drawing Figures

GUN AT REST

OPERATION STARTING

BOLT LOCKING

ROUND FIRED

BOLT UNLOCKING

BOLT RETRACTED

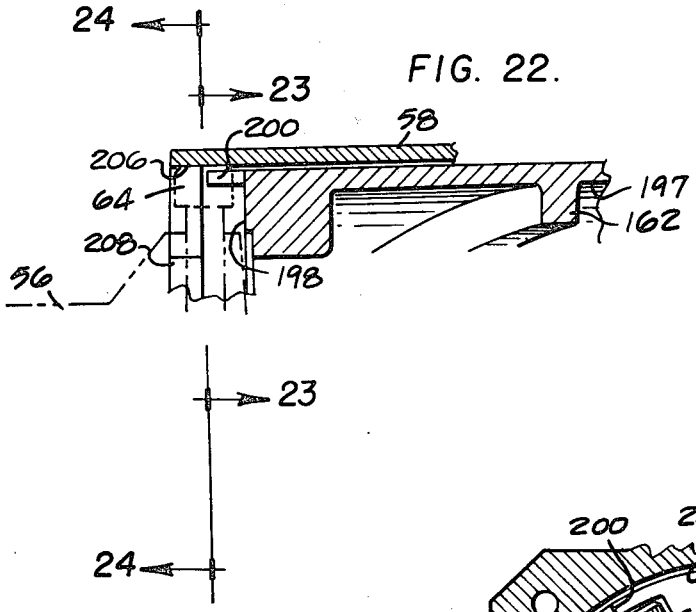
FIG. 22.
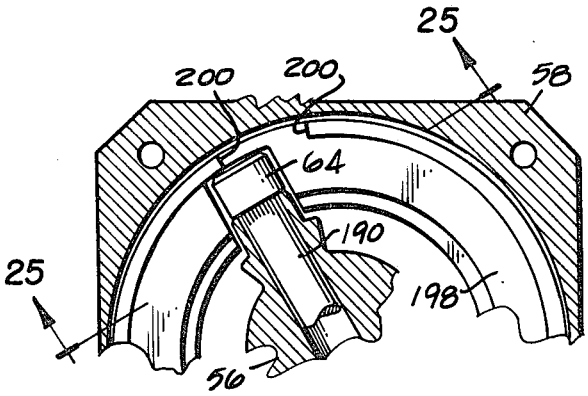
FIG. 23.
FIG. 24.
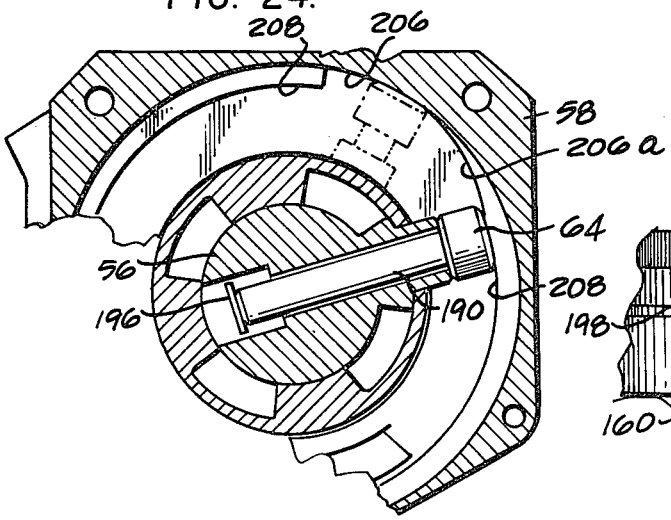
FIG. 25.
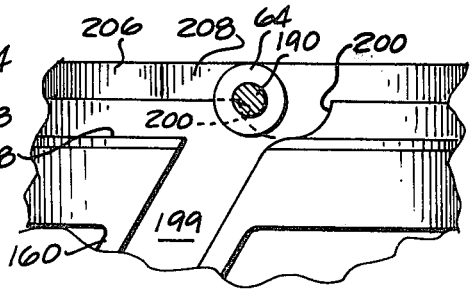

FIG. 26. FIRING POSITION
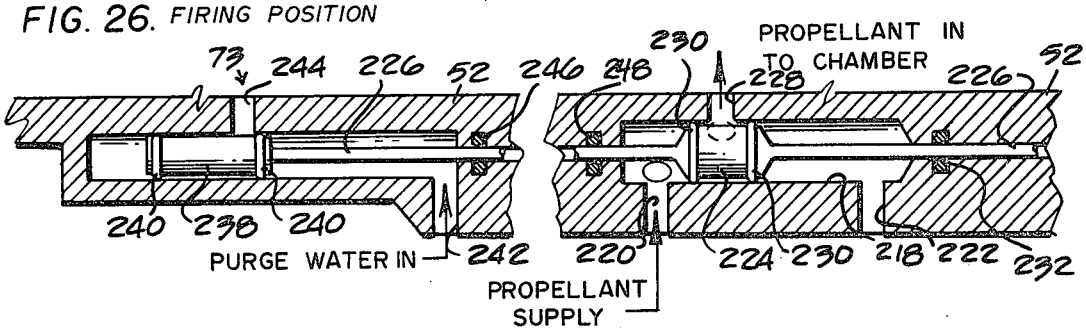
FIG. 27. PROPELLANT LOADING POSITION
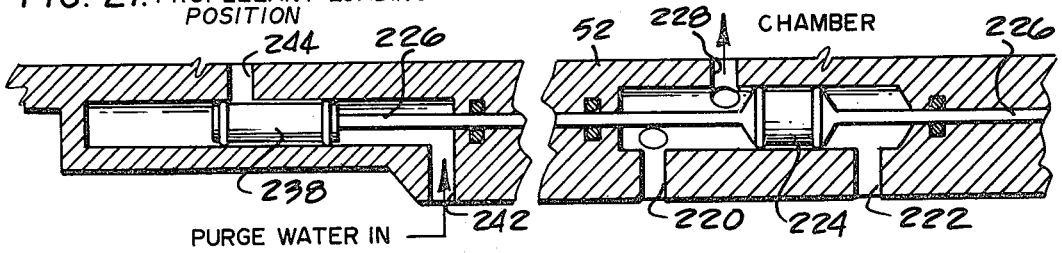
FIG. 28. EMERGENCY PURGE OR COMBUSTION CHAMBER COOLING
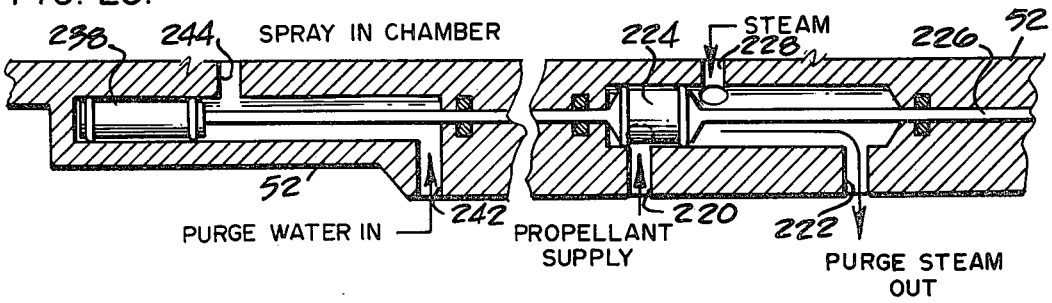
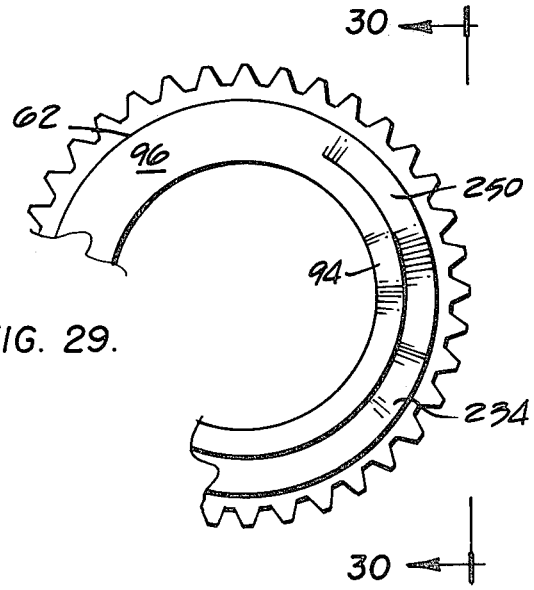
FIG. 29.
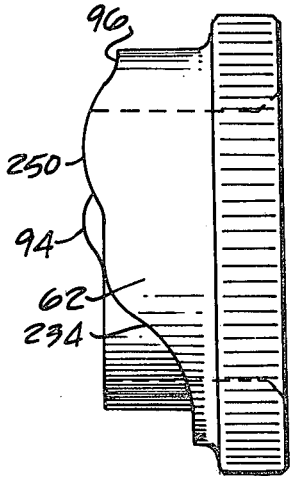
FIG. 30.

LIQUID PROPELLANT MODULAR GUN INCORPORATING DUAL CAM OPERATION AND INTERNAL WATER COOLING

This application is a division of parent application Ser. No. 616,822 filed Sept. 25, 1975, now U.S. Pat. No. 4,062,266, and entitled "Liquid Propellant Modular Gun Incorporating Dual Cam Operation and Internal Water Cooling" and claims the benefit of the filing date of the parent application.

BACKGROUND OF THE INVENTION

This invention relates to a liquid propellant gun of the kind in which liquid propellant is burned in a combustion chamber to fire a projectile from the gun. It relates particularly to a cam operated, externally driven, liquid propellant gun having a slim profile so that a plurality of single barrel gun modules can be conveniently clustered in a variety of configurations. The present invention also relates particularly to an internal water cooling arrangement which injects a small quantity of water into the combustion chamber for cooling by internal vaporization after the firing of each round and which also serves to fill the combustion chamber with water and to purge propellant from the combustion chamber in the event of a misfire.

The present invention has particular utility for high performance, high rate of fire guns in the 20 to 35mm size. The present invention is not, however, limited to guns of this size.

The existing weapons used by the armed services use solid propellant cartridges. These existing weapons carry the solid propellant in cases, and the cases form a substantial part of the overall weight and overall size of the cartridge. This in itself imposes serious drawbacks and limitations on the installation and use of such weapons, because the projectile feed mechanism and related storage facilities must be large enough and strong enough to store and transport not only the projectile itself but also the related solid propellant and case.

Solid propellants have a further inherent disadvantage because of the fact that solid propellants characteristically develop a high peak temperature. In many gun installations it is necessary to fire long bursts in multiple engagements. Such projected firing schedules produce severe thermal loads on the gun and often cause barrel errosion with the existing solid propellant weapons.

Automatic guns used in antiaircraft roles are a good example of guns subjected to severe firing schedules. Long bursts are needed to achieve high cumulative kill probabilities. These gun systems must also engage multiple targets in rapid succession with little or no time between burst for adequate cooling. A severe barrel cooling problem results which is a primary factor in limiting system effectiveness. The reduced accuracy associated with premature barrel erosion can effectively destroy gun capability during a single engagement. The alternative is to increase the number of available mounts to achieve an acceptable firing schedule. This results in additional weight, complexity, cost and maintenance problems, and is therefore an unacceptable solution.

The problem has long been recognized in high performance, gun installations such as the U.S. Navy 40 mm Bofors automatic gun and the Oto Melara 76/62. In both cases a classic approach to barrel cooling has been taken, i.e. water jacketing of the exterior barrel surface.

However, even with exterior water jacketing, the heat transfer rate may be too limited for some applications.

The problems of severe thermal loads and barrel erosion also occur in drilling by cannon excavation. In cannon excavation the firing rate is relatively low but the duty cycle is sustained for long periods of time, and this produces severe thermal loads on the barrel.

It is one important object of the present invention to provide a more effective means for barrel cooling. This object is achieved in the present invention by internal water cooling. The way in which the internal water cooling is incorporated in a liquid propellant gun of the present invention also permits the mechanism for injecting the water for cooling to be used as a water purge system for purging the combustion chamber of liquid propellant in the event of a misfire, and this system and mode of operation constitutes another, specific object of the present invention. The internal water cooling system will be reviewed in more detail below in the Summary of the Invention and in the Detailed Description of the Preferred Embodiments of the present invention. At this point the applicants would like to point out that, because the water does impinge directly on the heated gun bore surfaces in the present invention, high heat transfer rates are realized and the effectiveness of the internal water cooling permits significant increase in burst length and frequency in automatic guns. It also permits a significant increase in length of the duty cycle in such applications as drilling by cannon excavation.

There are a number of recognized technical objectives for high performance guns. In general, these include: (1) increased velocity and rate of fire; (2) lower gun and ammunition weight; (3) improved interior and exterior ballistic performance; (4) decreased erosion, flash and smoke; (5) reduced recoil loads; (6) elimination of cases, links and sabots; (7) improved reliability and safety; and (8) versatility—application to a wide range or requirements.

In addition to these general improvements, the following characteristics are recognized as being factors lacking in the prior art and needed to enhance the applicability of future gun systems as compared to the prior art: (1) a gun of minimum cross section to assure maximum versatility of installation on shipboard, vehicle and aircraft mounts; (2) an envelope that will assure retrofit capability or single or multibarrel high performance 30 or 35 mm liquid propellant guns in existing 20 mm installations; (3) a mechanism design capable of employing high density, low drag projectiles currently in the inventory or in an advanced stage of development; (4) at the 30/35 mm scale—utilization of existing projectile designs (with only minor modifications) to eliminate immediate requirements for development of new projectiles, and muzzle velocities in excess of 4000 ft. per second employing high sectional density projectiles to provide adequate standoff, short time of flight, and high projectile payload; (5) a gun mechanism construction adaptable to operation at higher muzzle velocities when adequate projectiles are available; (6) stationary barrel construction with rotating cam feed mechanism to provide significant reduction in gun drive power requirements and quicker acceleration to full firing rate; (7) simplified gun harmonization at all firing rates by elimination of tangential projectile velocity components associated with rotating barrel systems.

A further requirement which has been placed on gun development in guns of this size range is that the gun must be applicable across the board to sea, air and ground needs for the three services. These include (but are not limited to) small craft point defense, landing craft armament, retrofit of existing fixed wing aircraft and antiaircraft and antivehicle ground applications where rate of fire and configuration constraints vary widely. Some missions require single barrel guns with relatively low, adjustable rates of fire (0 to 1000 rpm). Others involve multibarrel installations at intermediate rates of fire (2000 to 3000 rpm), and finally there are those which require very high rates of fire (4000 to 6000 rpm). It can be seen that this range of rate of fire indicates that automatic guns are needed from one to eight barrels.

Liquid propellant guns have a characteristic low peak temperature. Because a liquid propellant will ignite in the bulk mode, it can be ignited, as by an electrical spark device immersed in the liquid propellant, without the need to vaporize the propellant prior to ignition. Liquid propellants are high energy density liquids and can be burned in discrete pulses to produce high combustion pressures. Pulsed burning of a liquid propellant can produce combustion pressures in the range of 10,000 to 80,000 psi and even higher. The magnitude of the average combustion pressure in such pulsed burning can be controlled by the amount of expansion permitted. Higher average combustion pressures can be produced by permitting less expansion.

The liquid propellant gun can produce a flatter combustion chamber pressure-time characteristic than a solid propellant gun. Hence, performance equivalent to a solid propellant gun can be obtained at lower pressure. High cyclic rates of fire are possible with a liquid propellant gun. Because the propellant is a liquid, the propellant can be easily pumped to the firing chamber from a storage area remote from the gun itself. This permits flexibility of installation. Because the cartridge feeding system of the liquid propellant gun carries only the projectile itself, the projectile feed system can be simplified and can be made considerably lighter in weight than for a conventional gun. Or, a considerably larger projectile size and weight can be used for higher performance without having to increase the size of the projectile feed mechanism. This is especially important in permitting larger bore liquid propellant guns to be incorporated in retrofit installations as replacements for existing smaller bore solid propellant guns.

Liquid propellant guns also permit slim profiles which provide desirable configuration versatility. Because the liquid propellant gun permits a low profile, clean exterior design, an individual liquid propellant gun module or a modular grouping of liquid propellant gun modules can be installed in locations that would not accomodate a conventional gun.

It is another important object of the present invention to incorporate the inherent advantages of a liquid propellant gun in a modular gun of the kind incorporating a drive cam and a control cam.

SUMMARY OF THE INVENTION

The liquid propellant gun of the present invention is a cam operated, externally driven gun constructed in modular form. It has a slim profile, and the operational features of the gun are arranged so that the gun can be readily incorporated in a variety of modular clusters, such as flat pack groupings and circular groupings.

The gun barrel is stationary and all combustion chamber pressure loads on the bolt are carried through the barrel rather than being carried through the receiver with the result that the receiver can be made quite light.

The gun incorporates two cams, a drive cam and a control cam.

The drive cam reciprocates the bolt back and forth between the rearward, projectile loading position and a forward, projectile firing position. The drive cam is a hollow cylindrical member having two spiral cam tracks formed on the inside of the drive cam. The first spiral cam track engages a cam follower on the bolt to drive the bolt forward, and the other spiral cam track engages the cam follower to drive the bolt rearward as the drive cam is rotated about the axis of reciprocation of the bolt.

The control cam is located at the front end of the drive cam, and the control cam is also an annular member which is rotated about the axis of the bolt. The control cam controls the injection of the liquid propellant into the combustion chamber and also controls the igniter for igniting the propellant.

The drive cam is rotated faster than the control cam and has dwell or rest areas at each end of the drive cam to provide the time intervals for the projectile loading at one end and the propellant injection and firing at the other end of the bolt's reciprocation.

The drive cam rotates the bolt in one direction at the end of its forward travel to lock the bolt to the barrel, and the control cam rotates the bolt in the opposite direction after firing to unlock the bolt from the barrel.

The axial sliding movement of the reciprocating bolt is guided by lugs on the bolt which interfit in slots in the barrel extension or receiver of the gun.

The cam follower of the bolt is mounted for a limited amount of radial movement with respect to the bolt to accomodate, by outward movement, the bolt rotation required to lock the bolt and, by inward movement, the required dwell at the forward end of the bolt travel. The barrel extension has a cam surface that coacts with the cam follower and a dwell area at the forward end of the drive cam to provide the required dwell in this part of the cycle of operation of the gun. The control can unlocks the bolt and returns the cam follower to the rearward, spiral drive cam track at the proper time.

The drive cam and the control cam are driven in synchronism by interconnected gearing, and the drive cams of adjacent gun modules are interconnected by idler gears for transferring drive from one module to the next.

The gun of the present invention incorporates a water cooling arrangement in which the control cam causes a small amount of water to be injected into the combustion chamber after the firing of each round. The injected water is vaporized and converted to steam as it contacts the hot combustion chamber structure, and this produces a highly effective cooling of the combustion chamber structure.

The water cooling valving is interconnected with the valving for the propellant injection in a manner such that the combustion chamber can be completely filled with water to purge the combustion chamber of propellant in the event of a misfire.

The gun incorporates misfire detection means which coact with the control can to completely disengage the control cam from the drive so that operation of the gun module is stopped in the event of a misfire.

Liquid propellant gun apparatus and methods which incorporate the structure and techniques described above and which are effective to function as described above constitute specific objects of this invention.

Other objects, advantages and features of our invention will become apparent from the following detailed description of preferred embodiments taken with the accompanying drawings.

BRIEF DESCRIPTION OF THE DRAWINGS

In FIG. 5 some parts are partly broken away to show details of construction and FIG. 5*a* is a continuation of the left hand end of FIG. 5;

FIG. 22 is a fragmentary, enlarged view of the part of the structure shown encircled by the arrows 22—22 in FIG. 6. In FIG. 22 as in FIG. 6, the cam follower is shown rotated 30° from its actual position illustrated in FIG. 13;

FIG. 23 is a fragmentary, enlarged end elevation view taken along the line and in the direction indicated by the arrows 23—23 in FIG. 22, but with the cam follower at the actual inclination illustrated in FIG. 13;

FIG. 24 is a fragmentary, enlarged end elevation view taken along the line and in the direction indicated by the arrows 24—24 in FIG. 22 showing the cam follower in the unlocked position in phantom outline and in a locked position in bold outline;

FIG. 25 is a fragmentary, enlarged bottom plan view taken along the line and in the direction indicated by the arrows 25—25 in FIG. 23;

FIG. 26 is a fragmentary enlarged side elevation view taken along the line and in the direction indicated by the arrows 26—26 in FIG. 5. FIG. 26 shows the positions of the water injection and the propellant injection control valves during firing of the gun;

FIG. 27 is a fragmentary enlarged side elevation view like FIG. 26 but showing the positions of the water injection and propellant injection control valves during propellant loading;

FIG. 28 is a view like FIGS. 26 and 27 but showing the positions of the water injection and propellant injection control valves during either the combustion chamber cooling or the emergency purge operations;

FIG. 29 is a fragmentary, enlarged view of the front face of the control cam and is taken generally along the line and in the direction indicated by the arrows 29—29 in FIG. 19. FIG. 29 shows the recess in the control cam for the control of the propellant injection, the projection on the control cam for the water injection and a projection on the control cam for controlling the operation of the igniter;

FIG. 30 is a fragmentary enlarged plan view taken generally along the line and in the direction indicated by the arrows 30—30 in FIG. 29;

FIG. 32 shows the feeding of specific projectiles in the endless conveyor belt to related gun modules;

FIG. 41 illustrates how a 30 mm liquid propellant round is approximately the same overall length as a conventional solid propellant 20 mm round and how it is therefore capable of being substituted in conventional projectile feed systems for smaller 20 mm solid propellant rounds with a minimum of retrofit modifications;

DESCRIPTION OF THE PREFERRED EMBODIMENTS

Figure 1:
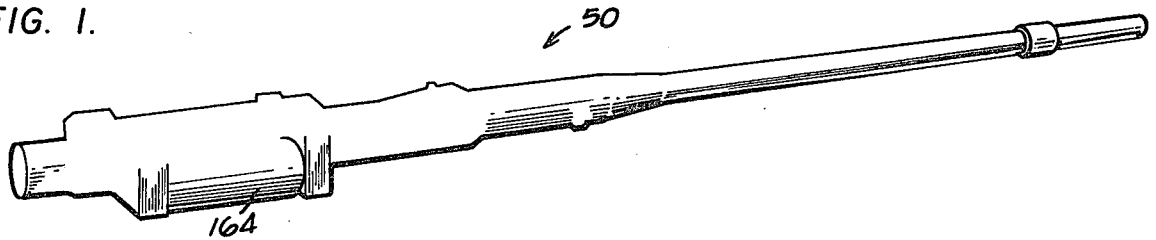
FIG. 1 is an isometric view of a liquid propellant gun module constructed in accordance with one embodiment of the present invention.
Figure 2:
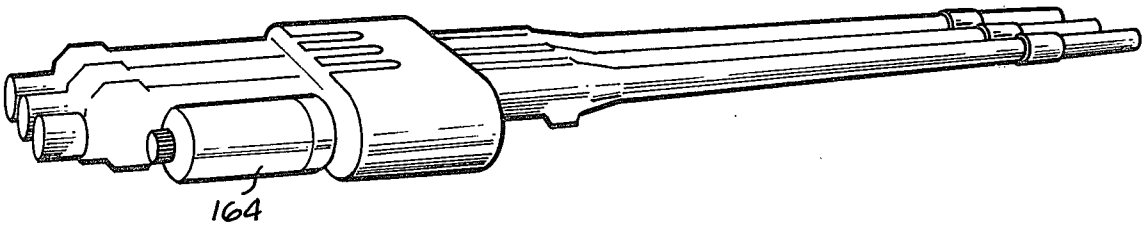
FIG. 2 is an isometric view showing three of the gun modules of FIG. 1 grouped in a flat pack cluster.
Figure 3:
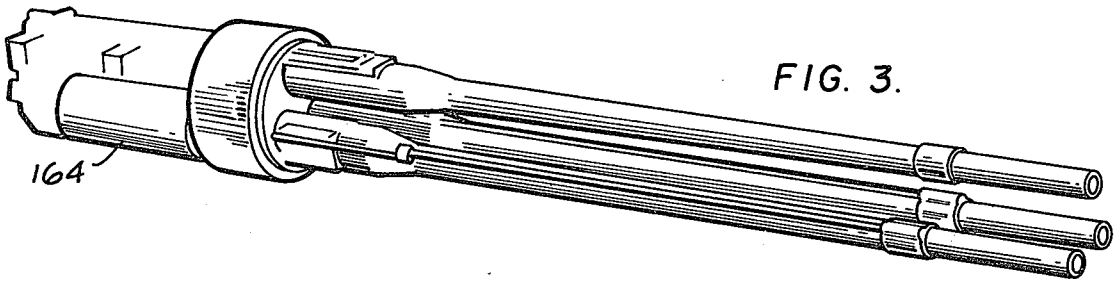
FIG. 3 is an isometric view showing three of the gun modules of FIG. 1 grouped in a circular cluster.

A liquid propellant gun module constructed in accordance with one embodiment of the present invention is indicated generally by the reference numeral 50 in FIGS. 1, 4, 5, 6 and 16 through 21.

Figures 4, 6, 6A:
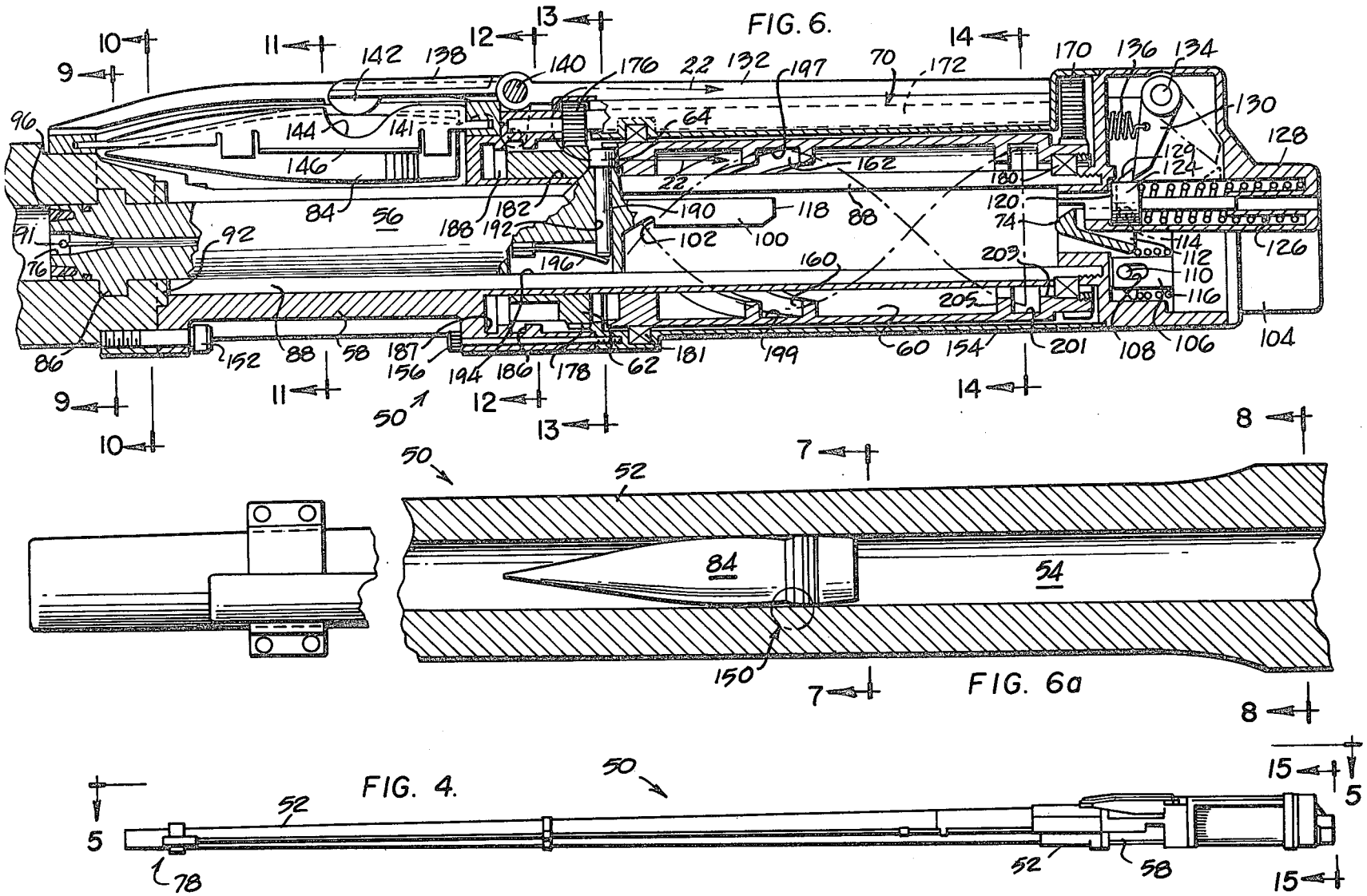
FIG. 4 is a side elevation view of the gun module shown in FIG. 1.
FIG. 6 is a side elevation view in cross section taken generally along the line and in the direction taken by arrows 6—6 in FIG. 5 and FIG. 5*a*.
FIG. 6*a* is a continuation of the left hand end of FIG. 6. The cam follower 64 is shown rotated 30° in FIG. 6 for better illustrating its operation. See FIG. 13 for the true position of this cam follower.
Figure 5:
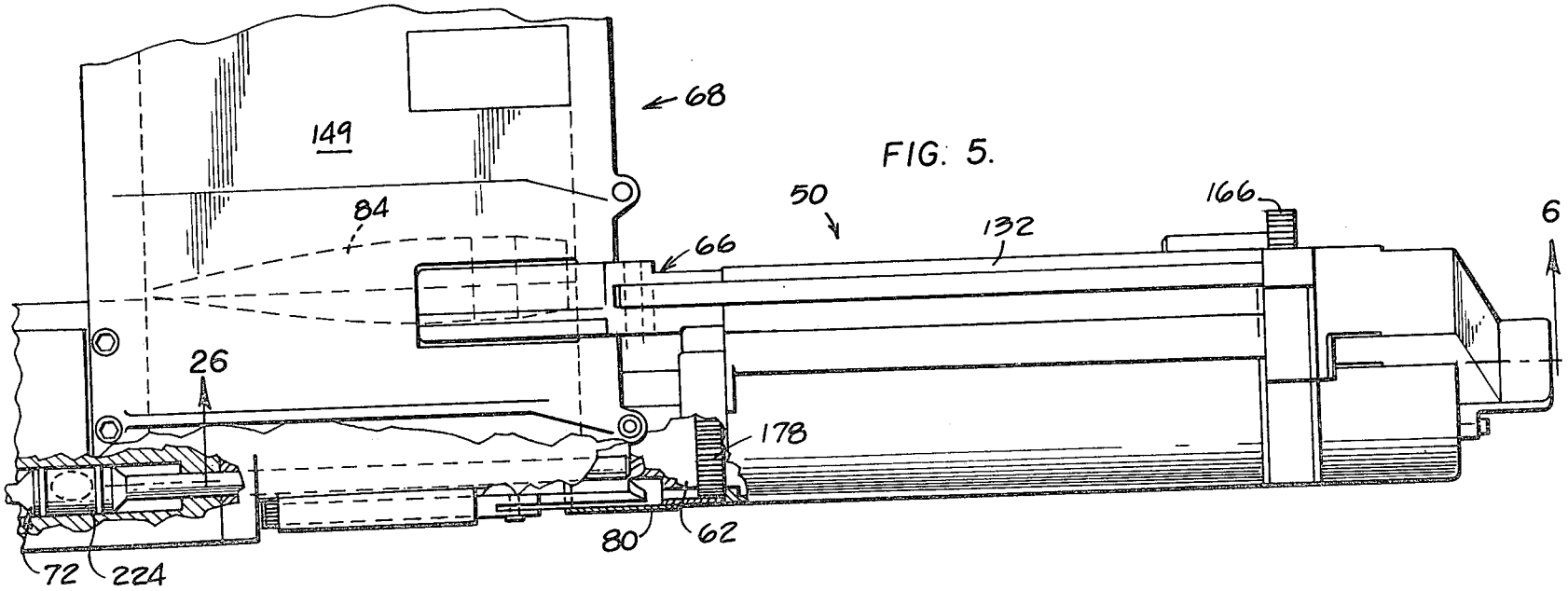
FIG. 5 is an enlarged top plan view of the gun module taken along the line and in the direction indicated by the arrows 5—5 in FIG. 4.
Figure 5A:
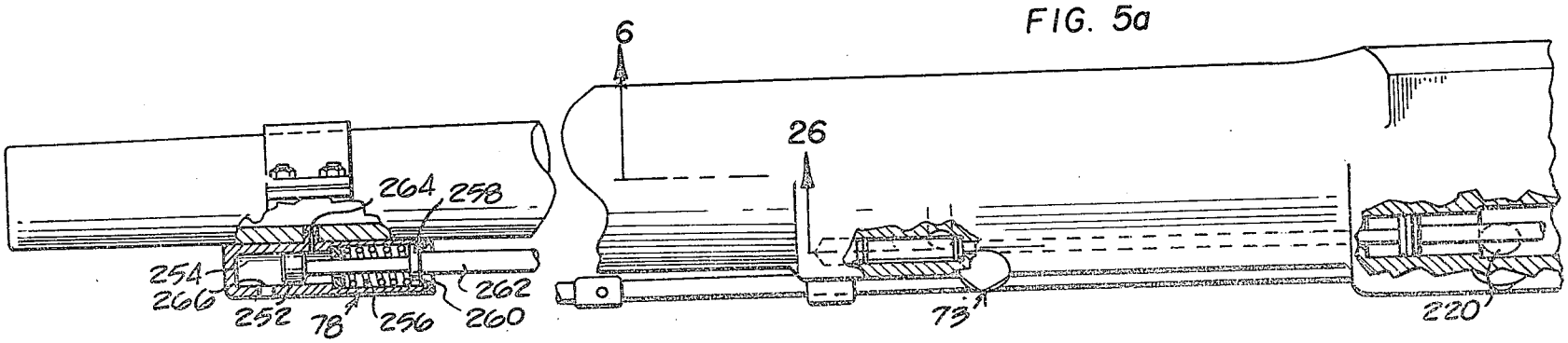

The gun module 50 includes a barrel 52, a combustion chamber 54, a bolt 56, a barrel extension or receiver 58, a drive cam 60, a control cam 62, a cam follower 64, a projectile loading mechanism 66 for loading projectiles from a projectile feeding mechanism 68, a drive mechanism 70, propellant injection means 72, water coolant and purge means 73, a bolt sear 74, an igniter 76, misfire detection means 78 and a misfire switch 80, all as indicated generally by these reference numerals in FIGS. 5 and 6 and in other FIGS. of the drawings.

The gun module 50 illustrated in the drawings use a liquid monopropellant (i.e. a liquid propellant that contains both a fuel and an oxidizer) in the combustion chamber 54 for firing a projectile 84. It should be noted, however, that many of the features of the present invention are not limited to a modular gun or to a gun using a monopropellant, as will become more apparent from the description to follow.

Figure 18:
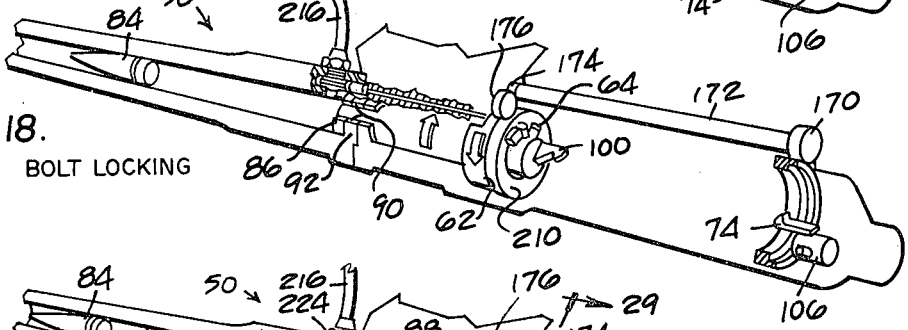
Figure 19:
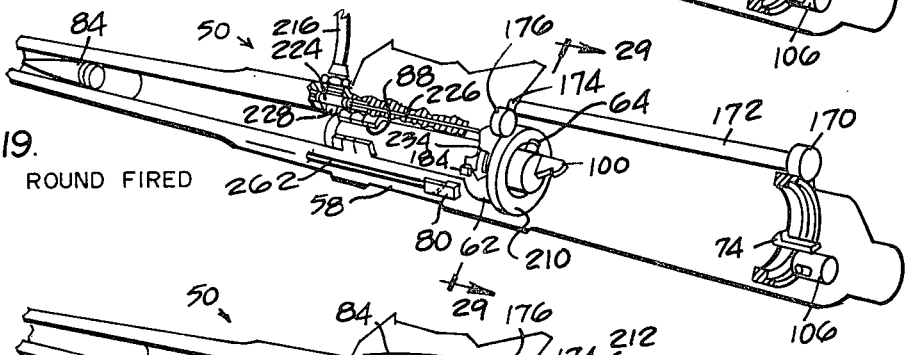
Figure 20:
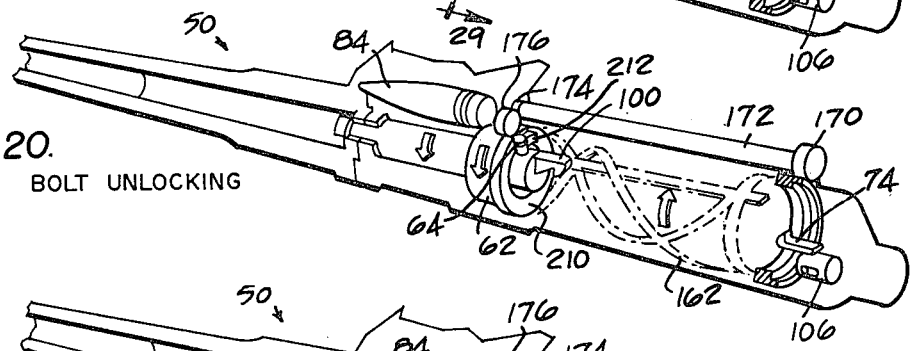
Figure 21:
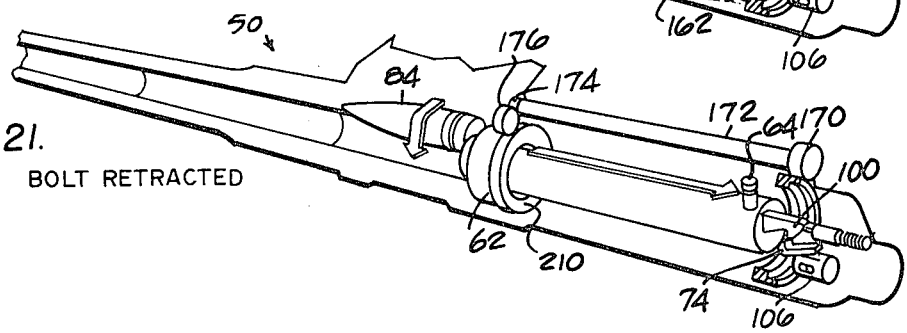

The bolt 56 is reciprocable back and forth between a rearward, projectile loading position (see FIG. 16) and a forward, projectile firing position (see FIGS. 18, 19 and 20).

Figure 9:
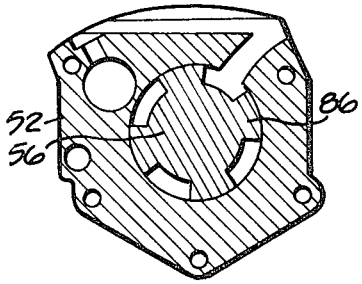
Figure 10:
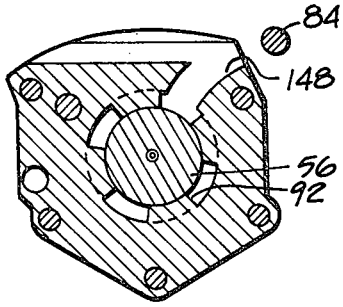
Figure 11:
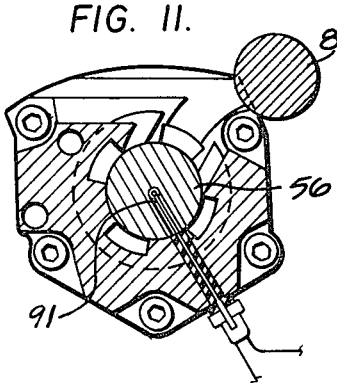

The bolt is guided in this reciprocating movement by lugs 86 (see FIG. 17 and FIG. 9) which slide within guide slots 88 (see FIGS. 19 and 11) in the barrel extension 58 and guide slots 90 (see FIG. 18 and FIG. 10) extending through locking lugs 92 at the rear end of the barrel 52.

The igniter 76 is located in the front face of the bolt 56 and comprises an electrode 91 (see FIG. 6 and FIG. 11) which is energized when a cam follower (not illustrated) is displaced by a projection 94 on a forward control face 96 of the control cam 62 (see FIGS. 29 and 30). Energization of the electrode 91 produces electrical energy which ignites the liquid propellant in the combustion chamber 54 to fire the projectile 84 out of the barrel 52. Ignition can also be accomplished by compression ignition or by injecting a chemical into the propellant.

The forward face of the bolt 56 has a seal 96 as best illustrated in FIG. 6.

The rear end of the bolt 56 has a bolt extension 100 which coacts with the projectile loading mechanism 68 to snap a projectile out of a spring clip carrier in the projectile feed mechanism 66 (in a way to be described in more detail below) when the bolt is moved to the rearward, projectile loading position.

The bolt extension 100 also has a detent 102 which is engaged by the pawl of the sear 74 to hold the bolt in the rearward position when the gun trigger is off and a sear solenoid 104 is deenergized.

A sear actuating rod 106 is connected to the rear solenoid 104 and has a slot 108 (see FIG. 6). A pin 110 rides in the slot 108 at the lower end of the pivot arm and is connected at the lower end of the pivot arm 112 of the sear 74. The arm 112 pivots about a sear pivot 114 which straddles the spring cavity. As illustrated in FIG. 6, a spring 116 normally biases the sear pawl 74 toward a bolt retaining position, but energization of the sear solenoid 104 rotates the pawl 74 downward to the bolt releasing position (best illustrated in FIG. 21).

The end face 118 of the bolt extension 100 is engageable with a face 120 of a spring backed part 124 which actuates the projectile loading mechanism 66. The back face of the part 124 provides a spring seat for one end of a bolt return spring 126. (See FIG. 6). The other end of the bolt return spring 126 is seated against an inner face of a rear cover 128.

The part 124 has an upwardly projecting flange 129 which is engageable with an actuator level 130 of the projectile loading mechanism 66. The upper end of the actuator level 130 is connected to a push rod 132 by a pin joint connection 134, and a spring 136 maintains the lower end of the actuator lever 130 in engagement with the upwardly extending flange 129.

The front end of the push rod 132 is connected to a bellcrank loading lever 138 by a pin joint connection 140. The downwardly extending arm of the bellcrank projectile loading lever 138 is pivotally connected to the barrel extension 58 by a loading lever pivot 141.

The forwardly extending arm of the projectile loading lever 138 has a lower end 142 which is positioned over an upper recess 144 in a spring clip carrier 146 for a projectile 84. This projectile is aligned with the upper end of a projectile receiving passageway 148 in the barrel extension 58 (see FIGS. 10 and 11).

Engagement of the bolt extension 100 with the rod 120 moves the lower end of the actuator lever 130 about the pivot provided by the connection to the spring 136 to shift the rod 132 forward. This pivots the bellcrank 138 about the pivot 141 and snaps a projectile 84 out of the spring clip carrier 146 of the endless conveyor belt 149 (see FIG. 32) of the projectile feed mechanism 68.

The projectile drops into the passageway 148 and into the bore in the barrel extension in front of the bolt 56. Forward movement of the bolt 56 then pushes the projectile up into the barrel 54, and the projectile 84 is then pumped forward (to the position illustrated in FIG. 6) against the forcing zone 150 by the liquid propellant injected into the combustion chamber. This will be described in greater detail below.

The barrel 52 is connected to the barrel extension 58 by cap screws 152 (see FIG. 6).

A cam cover 154 is connected to the barrel extension 58 by cap screws 156 as also shown in FIG. 6.

The drive cam 60 has two internal, spiral shaped, cam paths 160 and 162 which are engageable with the cam follower 64 for reciprocating the bolt 56 forward and backward during operation of the gun. The spiral cam track 160 drives the bolt 56 forward, and the spiral cam track 162 drives the bolt 56 rearward.

The drive cam 60 is axially elongated so that the cam angles are not too high, and the drive cam is rotated faster than the control cam 62.

As best shown in FIGS. 1–3 and 31, the drive system 70 includes a drive motor 164. The drive motor 164 rotates an idler gear 166, and the idler gear 166 is engaged with a gear 168 formed on the outer diameter of the drive cam 60 at the rear end of the drive cam 60.

Figure 15:
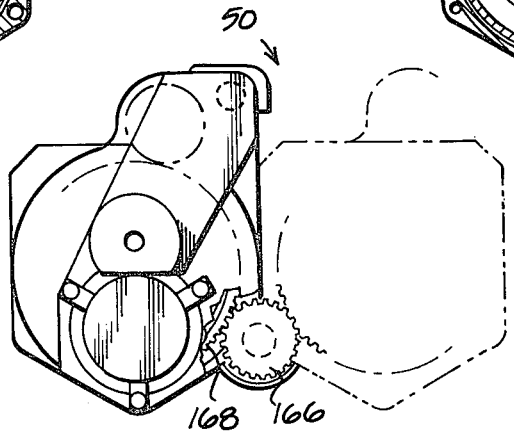
FIG. 15 is an end elevation view taken along the line and in the direction indicated by the arrows 15—15 in FIG. 4.
Figure 16:
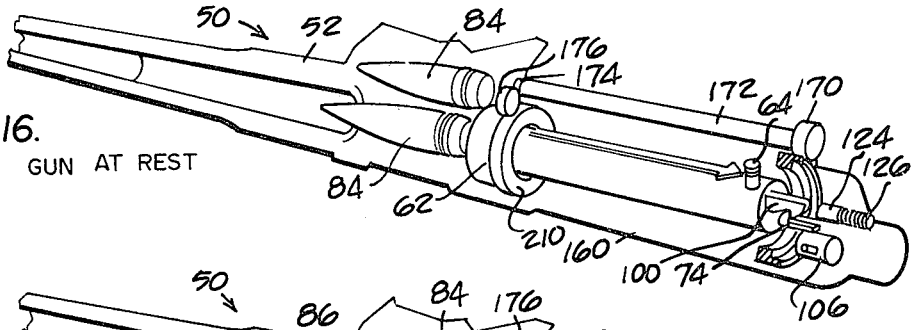
FIGS. 16–21 are isometric views showing the disposition of certain parts of the gun in the various phases of operation indicated by the legends in these figures.
Figure 17:
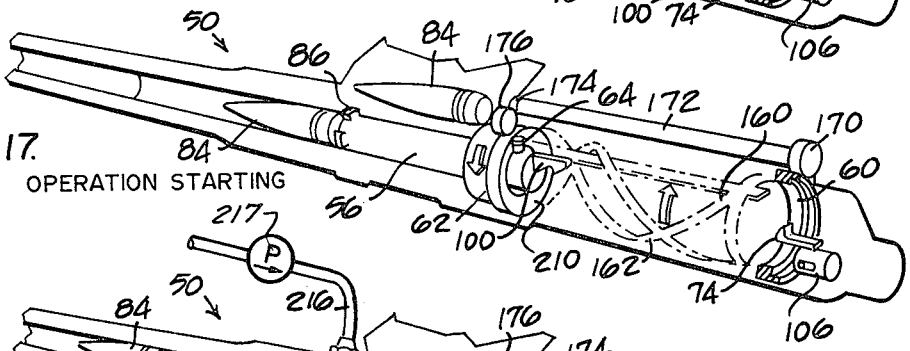

FIG. 15 illustrates how this same idler gear 166 is used to transfer the drive from one module to an adjacent module in a cluster arrangement.

The drive to the control cam 62 is provided by a jack shaft take off gear 170, a jack shaft 172, a jack shaft pinion gear 174, an idler gear 176 and a gear 178 formed on the outer diameter of the control cam 62 (as best illustrated in FIGS. 6 and 16 through 21). The control cam 62 is therefore rotated in a direction opposite from that of the drive cam 60, as indicated by the arrows in FIG. 17.

In a particular embodiment of the present invention the gear ratios are such that the drive cam 60 is rotated four times as fast as the control cam 62.

The drive cam 60 is mounted for rotation on the barrel extension 58 by bearings 180 at the rear end of the drive cam and 181 at the forward end of the drive cam (see FIG. 6).

Figure 12:
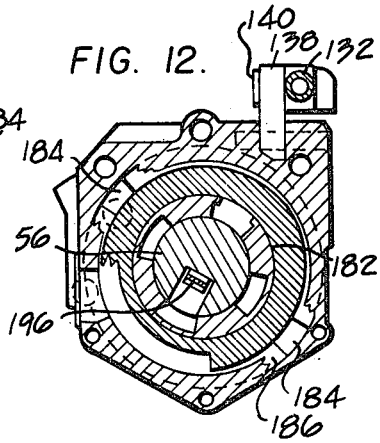
Figure 43:
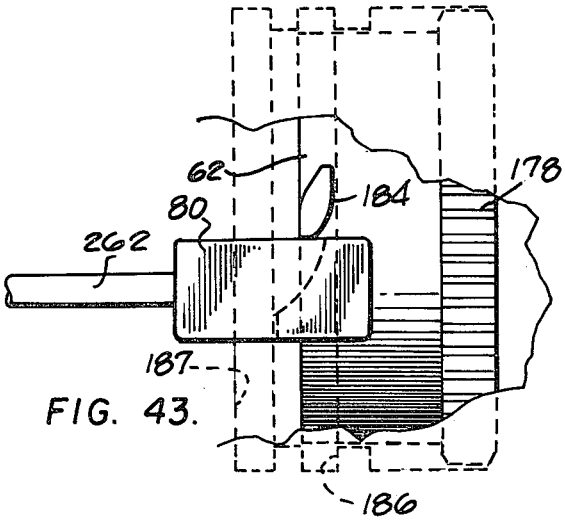
FIG. 43 is a fragmentary side elevation view taken along the line and in the direction indicated by the arrows 43—43 in FIG. 42.
Figure 42:
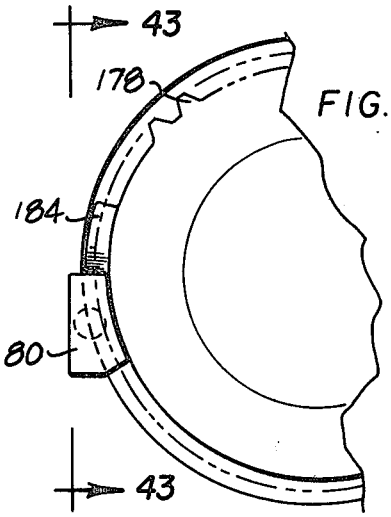
FIG. 42 is a fragmentary and elevation view showing details of the misfire switch and control cam shifting lug.

The control cam 62 is mounted for rotation on a surface 182 of the barrel extension 58 and is normally retained in a fixed axial position with respect to the barrel extension 58 by two radially projecting cam lobes 184 on the outer periphery of the control cam 62 (see FIG. 12). The lobes 184 travel in an annular groove 186 in the barrel extension 58. In normal operation of the gun the lobes 184 travel in the groove 186 and the control cam 62 is maintained in the fixed axial position illustrated in FIG. 6 with the gear 178 engaged with the gear 176. However, the barrel extension 58 has a relieved space 188 in front of the control cam which permits the control cam to be shifted axially forward and disengaged from the drive connection with the idler gear 176 in the event of a misfire. in this condition of operation as illustrated in FIG. 43 and as will be described in more detail below, the misfire switch 80 engages one of the cam lobes 184 to move the control cam 62 forward. The cam lobe that engages the misfire switch is diverted into a dead end side track 187, and the other lobe 184 enters a relieved area.

Figure 13:
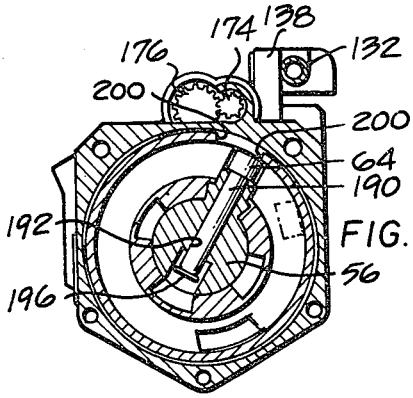
Figure 14:
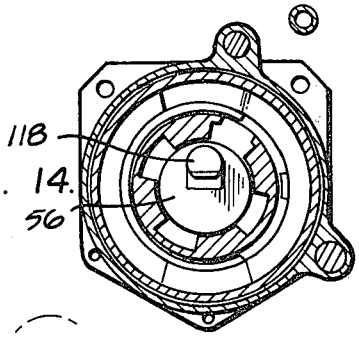

As best illustrated in FIGS. 6 and 13, the cam follower 64 is a cylindrical element at the outer end of a rod 190. The rod 190 is mounted for axial movement in a radially extending bore 192 at the back end of the bolt 56. The underside of the bolt 56 has a recessed groove 194, and a leaf spring 196 is mounted in the groove 194 so as to engage the lower end of the rod 190. The spring 196 biases the cam follower radially outwardly and into engagement with associated surfaces on the drive cam 60 and, during part of the time that the bolt 56 is in its forward projectile firing position, with associated large diameter surface 206 and smaller diameter surface 208 on the barrel extension 58. See FIG. 24. This will be described in more detail below.

During forward driving movement of the bolt 56, the outer surface of the cam follower 64 is engaged with a surface 199 of the forward driving cam track 160. See FIGS. 6, 17 and 22. During rearward driving of the bolt 56, the outer surface of the cam follower 64 is engaged with a surface 197 of the spiral cam track 162.

The drive cam 60 has dwell or rest areas at the front and rear ends of the drive cam. The dwell areas provide turnarounds at each end of the bi-directional drive cam.

The rear dwell area includes a surface 201 which is bounded by a rear, radially inwardly extending flange 203 and a forward, inwardly extending flange 205. See FIG. 6. This dwell area at the rear of the drive cam holds the bolt 56 in a retracted position from the time that the cam follower 64 leaves the return cam track 162 until the drive cam is rotated to a position in which an opening in the forward flange 205 permits the bolt return spring 126 and part 124 to shove the cam follower 64 into the forward drive cam track 160.

In a particular embodiment of the present invention (having the 4 to 1 ratio of drive cam revolutions to control cam revolutions for each cycle of operation as noted above), the cam follower 64 rests at the rear dwell area of turnaround for 0.6 turn of the drive cam 60. The forward drive spiral 160 moves the cam follower forward for 0.8 turn of the drive cam 60. The cam follower moves rearward for 0.8 l turn of the drive can and rests at a forward dwell area for approximately 1.8 turns of the drive cam 60.

When the bolt 56 reaches the forward end of its travel, it must be rotated 45° (as illustrated in FIG. 13) to lock the lugs 86 on the bolt in front of the lugs 92 of the barrel 52 (see FIG. 18).

The construction of the forward end of the drive cam 60 and related structure of the barrel extension 58 and back face of the control cam 62 are best illustrated in the enlarged fragmentary view of FIG. 22.

As best illustrated in FIG. 22, when the cam follower 64 leaves the forward end of the forward drive cam track 160, the back side of the cam follower 64 is positioned in a forward dwell area 198 so that continued rotation of the drive cam 60 cannot produce any continued forward movement of the bolt 56.

The drive cam 60 does, however, have a slot 200 (see FIGS. 22 an 23) located at the forward, outlet end of the forward cam track 160 so that the spring 196 (see FIG. 6) shoves the rear half of the cam follower 64 outward and into this slot 200 as soon as the forward reciprocation of the bolt has been completed. The rotation of the drive cam 60 in the clockwise direction indicated by the arrow in FIG. 17 then rotates the cam follower and bolt 45° to the locking position illustrated in FIG. 18.

At the same time that the back half of the cam follower 64 moves into the slot 200, the front half of the cam follower 64 engages the large diameter surface 206 (see FIG. 24) of the barrel extension 55. This surface 206 has a ramp 206*a* which decreases in diameter, as the bolt is rotated 45° to the locked position, until the diameter is the same as that of the surface 208. This ramp 206*a* pushes the cam follower 64 downward from the outwardly extended position shown in phantom outline in FIG. 24 to the retracted position shown in solid outline in FIG. 24.

The surface 208 thereafter engages the top of the front half of the cam follower 64 to retain the cam follower 64 in the retracted position and within the groove 198 of the drive cam 60 until the firing of the projectile from the combustion chamber 54 has been completed and the bolt 56 is ready to be rotated back 45° to an unlocked position and then retracted to the projectile loading position by engagement of the cam follower 64 within the rear drive cam track 162.

While the cam follower 64 is retained in the retracted position illustrated in FIG. 24 by the stationary engagement of the cam follower 64 with the surface 208 at the end of the ramp 206, the drive cam 60 is of course continuing to rotate with respect to the cam follower 64 with the back half of the cam follower 64 engaged in the relieved area of the recessed face 198. At the same time the rear face 210 of the control cam 62 is rotating counter clockwise with respect to the cam follower 64, as illustrated by the arrows in FIGS. 18 and 19.

The rear face 210 of the control cam has a bolt unlocking and return wedge 212 projecting outwardy from the rear face 210. As this wedge rotates into engagement with the cam follower 64, it first of all rotates the cam follower and bolt 45° counter clockwise (as viewed in FIG. 20) to unlock the bolt by aligning the lugs 86 with the slots 90. Continued rotation of the control cam 62 then moves the cam follower 64 axially to the rear and into the front inlet end of the rear drive cam track 162, as this end of the cam track 162 opens to the front dwell area 198. Continued rotation of the drive cam 60 then reciprocates the bolt 56 to a rearward, projectile loading bolt position.

Figure 44:
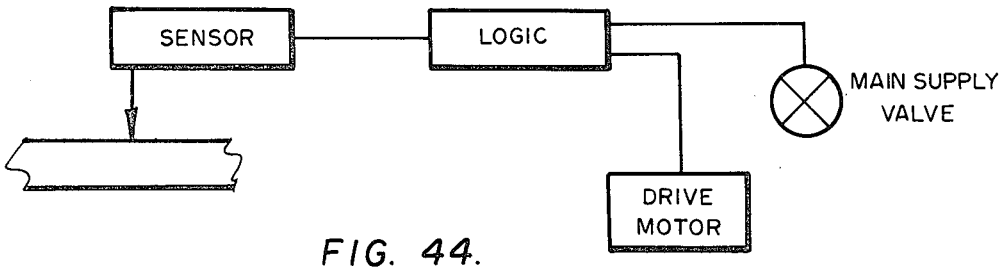
FIG. 44 is a schematic view of a pressure sensing interlock system for stopping operation of a gun module in the event of a drop in propellant feed pressure.

The gun 50 as illustrated in the drawings uses a liquid monopropellant, i.e. a liquid propellant having both a fuel and an oxidizer. Mixtures of hydrazine, hydrazine nitrate and water are examples of monopropellants that may be used. However, propellants developed for torpedo application have physical, performance, handling and safety characteristics that are well suited for use in the present invention. This is understood since torpedo propellants must be compatible with the long duration, closed environment of a submarine where adverse characteristics from the standpoint of toxicity, handling or safety are completely intolerable. The liquid propellant is stored, either adjacent to the gun 50 or remotely, and is conducted to the propellant injection means 72 by a flex conduit 216 as shown in FIGS. 18 and 19. The propellant supply pressure is supplied either by pump or by an accumulator subsystem (not illustrated). The accumulator is preferable from the standpoint of being effective in reducing pump volume requirements while meeting the peak flow rates necessary for burst fire. The propellant supply system includes a pressure sensing interlock system (see FIG. 44) which senses the propellant pressure by means of a sensor and stops operation of the complete group (row or cluster) of gun modules by closing a main propellant supply valve and stopping operation of the drive motor when the supply pressure drops below an established level. This prevents incomplete propellant filling.

The porting and valving arrangement for controlling the injection of liquid propellant into the combustion chamber 54 is best shown in FIGS. 5, 8, 18 and 26–28 of the drawings.

As best illustrated in FIG. 26, the sidewall of the barrel 52 has an axially extending bore 218 at one side of the combustion chamber 54, and the propellant conduit 216 is connected with a port 200 at one end of the bore. A port 222 connects the other end of the bore to drain.

A spool valve 224 is mounted for axial movement within the bore 218, and the control of the position of the spool valve 224 is provided by a valve control rod 226 which is connected to the valve spool 224 at one end. The other end of the rod 226 is engaged with the front face 96 (see FIG. 29) of the control cam 62 and acts as a cam follower.

A port 228 connects the axial bore 218 with the combustion chamber 54.

The valve spool 224 has annular seals 230 at each end of the spool and the rod 226 is sealed by a seal 232 as illustrated in FIG. 26.

The cam face 96 of the control cam 62 is formed with a recessed ramp 234 which controls the duration of the time period for injection of the liquid propellant through the ports 220 and 228. The control rod 226 is biased (by the propellant supply pressure) to the right (as viewed in FIG. 26) so that the cam follower end of the rod 226 is maintained in engagement with the face 96 of the rotating control cam 62.

In the firing position, the valve spool 224 is positioned by the control rod 226 to block off the port 228 (as illustrated in FIG. 26).

FIG. 27 illustrates the position of the valve spool 226 with respect to the port 228 when the recess 234 of the control cam 62 has been rotated to a position in which the control rod 226 first drops down into the recess 234. The valve spool 224 is shifted to the right in the bore 226 to open the port 228 for communication with the port 220, and the liquid propellant flows into the combustion chamber under the pressure of the propellant supply system. The pressure of the inflowing propellant pumps the projectile 84 forward to the position illustrated in FIG. 6*a*. The inclined ramp in the recess 234 pushes the control rod 226 leftward and back to the position illustrated in FIG. 26 as the cam follower end of the control rod 226 returns to the plane of the front face 96 of the control cam 62. The amount of liquid propellant injected is therefore determined by the pressure of the propellant supply system and the length and angular inclination of the recess 234.

As illustrated in FIG. 29, the front face 96 of the control cam 62 has a projection 94 which is engaged by a spring biased cam follower. The electrode 92 is energized as the igniter cam follower is actuated by the projection 94 following the filling of the combustion chamber 54 with the liquid propellant.

A very important feature of the present invention is the internal water cooling provided by the coolant injection means 73.

The coolant injection means 73 inject a small quantity of water directly into the firing chamber 54 between rounds. Since water impinges directly on the heated gun bore surfaces, high heat transfer rates are realized. The effectiveness of the internal water cooling permits a significant increase in burst length and frequency in the case of an automatic gun fired at high cyclic rates and permits a significant increase in the length of the duty cycle of guns used at lower cyclic rates such as in common excavation.

In a specific embodiment of the present invention water is used as the cooling liquid because it has a high heat of vaporization and is readily available. Other liquid coolants can of course be used, but the description to follow will be directed specifically toward the use of water as the coolant liquid.

One embodiment of the valve structure for accomplishing the internal water cooling is illustrated in FIGS. 5 and 26–28. As illustrated in these drawings, the wall of the gun barrel 52 has an axially extending bore 236. A valve spool 238 is mounted for reciprocation within the bore, and the valve spool has seals 240 at each end.

A water inlet port 242 is connected to one end of the bore 236 and a hose is attached to this port 242 to connect the port to a pressurized water supply system.

A port 244 connects the bore 236 to the combustion chamber 54.

The valve spool 238 is connected directly to the valve spool 224 through an extension of the rod 226 so that the water coolant valve spool 238 moves in unison with the propellant injection valve spool 224.

Seals 246 and 248 seal off the part of the rod 226 extending between the bores 236 and 218.

In the firing position of the valve spools (as illustrated in FIG. 26) the valve spool 236 blocks flow of water into the port 224 and flow of combustion gases out of the port 244.

Similarly, the water injection valve spool 238 is positioned in the propellant loading position illustrated in FIG. 27 to block flow through the port 244.

However, immediately after firing, the control cam 62 rotates to a position in which a projection 250 shifts the control rod 226 leftward (as viewed in FIG. 28) by an amount sufficient to open the port 244. This projection 250 permits a short time period for the injection of coolant water into the combustion chamber (through the passageway provided by the ports 242, the bore 236 and the port 244) before the cam follower end of the control rod 226 moves down off the projection 250 and back onto the plane of the face 96. This small amount of water is vaporized by the hot wall structure of the combustion chamber and turned to steam. During this water injection period, the port 228 may be maintained closed by the land 224 or, depending on the size of the projection 250, the port 228 may also be opened for venting of gas and steam from the combustion chamber (through the port 228 and the bore 218 and the vent port 222).

Thus, immediately after firing each round, the coolant injection means 73 are opened and a metered quantity of water is injected directly on the forward portion of the combustion chamber 54. The water spray is directed toward the combustion chamber surfaces of the gun. The quantity of water is metered to insure that virtually all of it is converted to steam.

The next projectile 84, in the process of being loaded and pumped forward in the chamber, pushes any steam and water remaining in the chamber ahead of the projectile into the barrel. After firing, the residuals are forced out of the barrel by the projectile as it traverses the bore.

If the distribution of the water vapor in the bore is assumed to be the same as the normal products of combustion of a liquid propellant, the weight of gas (vapor) being pushed out by the projectile is slightly less than that for a conventional solid propellant round. This results from the somewhat lower molecular weight of liquid propellant combustion products and that of the water vapor.

The internal water cooling is optimized to inject no more water than is vaporized. Hence, there is no penalty for acceleration inert mass. The water injected is controlled by the dwell of the surface 250 of the control cam 62.

Heating and cooling of a gun barrel bore surface is highly transient. The analysis of the instantaneous heat transfer process is complex and methods for accurately determing the heat transfer coefficient controlling the process are not well established. However, the following example, based on average conditions, does illustrated the effectiveness of the internal water cooling.

Considering a 35 mm 4,000 ft/sec muzzle velocity liquid propellant gun, the significant characteristics are:

Projectile Weight—1.2 lb.
Muzzle Velocity—4,000 ft/sec.
Propellant Charge—1 lb.
Projectile Muzzle Kinetic Energy—298,000 ft.-lb.
Firing Rate—750 rounds per minute Estimates of barrel heating per round are calculated using the criteria established by Corner[1] where the heat loss Q is:

$$Q = X\left(\tfrac{1}{2}W_1V^2\right)$$

$W_1$ = "Effective" Mass of the projectile
V = Muzzle velocity
$X \cong 0.3$ (maximum value)

1"Theory of the Interior Ballistics of Guns". J. Corner. Pg. 141. John Wiley & son.

For the characteristics of the 35 mm 4,000 ft/sec LPG, Q = 124,000 ft.-lb. (or 161 B.t.u.).

Gun barrel cooling is accomplished by direct water injection on the interior heated surfaces. Assuming initial water temperature to be 70° F., the heat absorption capability of the injected water (including specific heat and heat of vaporization) is approximately 1,110 B.t.u./lb. The quantity of water required for complete cooling after each round is then $$= \frac{161 \text{ B.t.u./round}}{1110 \text{ B.t.u./lb.}H_2O} \text{ or } .146 \frac{\text{lb.}H_2O}{\text{round}}.$$

In a rapid fire automatic weapon, the time available for cooling between rounds is limited by heat transfer rate. At a firing rate of 750 rounds per minute, the cycle time per round is 80 milliseconds.

The heat transfer rate can be estimated from the following:

$q = hA\Delta T$ q = rate of heat transfer B.t.u./hr.
h = heat transfer cooefficient B.t.u./hr. of ft$^2$
A = area ft$^2$
$\Delta T$ = temperature difference °F.

For estimating the heat transfer rate, the following assumptions are made:

(a) $\Delta T$

Bore surface temperature rises of 1,200°–1,400° F. in one millisecond have been measured in liquid propellant guns at the origin of rifling. Since rapid injection of cooling water immediately after firing is involved in the present method, large average temperature differences will exist during the cooling process. Here a conservative $\Delta T$ of 500° F. is assumed.

(b) Area

The chamber bore surface area is 0.375 ft$^2$. It is assumed that the injected cooling water is effectively sprayed over an area at least equivalent to this, therefore, the effective area is assumed to be 0.375 ft$^2$.

(c) Heat Transfer Coefficient

Water sprayed against hot surfaces boils violently and is rapidly vaporized. Boiling heat transfer coefficients are quite high. Coefficients of 300,000 B.t.u./hr.ft$^2$ °F. are common. Here, the heat transfer coefficient conservatively is assumed to be 250,000 B.t.u./hr.ft$^2$°F.

Based on these considerations, the rate of heat transfer is estimated to be:

$$q = \left(250{,}000 \frac{\text{B.t.u.}}{\text{hr. ft}^2\text{°F.}}\right)(.365 \text{ ft}^2)(500\text{° F.}) = 4.7.10^7 \frac{\text{B.t.u.}}{\text{hr.}} \text{ or } 1.3 \times 10^4 \frac{\text{B.t.u.}}{\text{sec}}$$

Since complete cooling per round requires removal of 161 B.t.u. the required cooling time is:

$$t = \frac{161 \text{ B.t.u.}}{1.3.10^4 \frac{\text{B.t.u.}}{\text{sec}}} = 12.4 \text{ milliseconds}$$

With a total cycle time per round of 80 milliseconds there is ample cooling time available.

The above example is idealized in that perfect distribution of the cooling water over the heated surfaces is assured. While complete cooling is not usually attained in practice, a substantial portion of the heat imparted to the gun is removed. This has a major impact on firing schedule and gun system effectiveness.

FIG. 28 illustrates the disposition of the valve spools 238 and 224 in the event of a misfire, when it is desired to purge the combustion chamber 54 of all liquid propellant within the combustion chamber. In this event, the entire control cam 62 is shifted axially forward by the misfire detection switch 80, and this shoves the control rod 226 leftward to the position illustrated in FIG. 28 where the valve spools 238 and 224 are held in the positions illustrated. The coolant water flows continuously into the combustion chamber through the coolant inlet port 244, fills the combustion chamber 54 completely with water, and purges out all of the liquid propellant through the port 228 and the vent 222.

Figure 7:
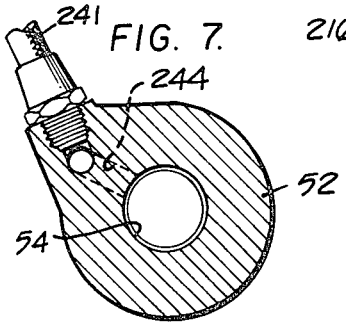
FIGS. 7–14 are end elevation views in cross section taken along the lines and in the directions indicated by the correspondingly numbered arrows in FIG. 6.
Figure 8:
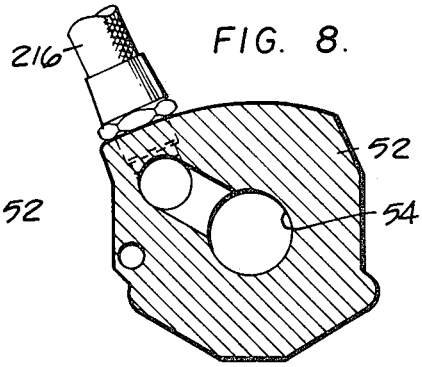

A timing device, not illustrated, shuts off the flow of water through the hose 241 (see FIG. 7) after a period of time sufficient to insure complete purging of the combustion chamber.

As described above in this specification, the misfire switch 80 is controlled by the misfire detection means 78 (see FIG. 5).

The misfire detection means 78 include a gas piston 252 mounted for reciprocation within a cylinder 254 and spring biased by a spring 256 rightward (as viewed in FIG. 5) to the position illustrated in FIG. 5 where a flange 258 engages a snapring stop 260.

A connecting rod 262 connects the gas piston 252 to the misfire switch 80 so that the misfire switch 80 is normally spring biased to the position illustrated in FIG. 5 in which the misfire switch 80 is axially aligned with the lobes 184 on the control cam 62.

A port 264 connects the bore of the barrel 52 with the interior of the cylinder 254 at the back face of the gas piston 252.

A vent port 266 is located in the sidewall of the cylinder to vent the interior of the cylinder 254 to atmosphere.

As a projectile is fired from the gun, the pressurized gases behind the projectile flow through the port 264 to momentarily move the gas piston 252 forward (leftward as viewed in FIG. 5) within the cylinder 254. This pulls the misfire switch 80 forward and out of alignment with the lobe 184 on the control cam long enough to let this lobe rotate past the misfire switch without engaging the misfire switch 80.

However, if there is a misfire, the gas piston 252 remains stationary and the misfire switch 80 engages the cam lobe 184 to divert the cam lobe into a dead side track 187 (see FIG. 43 and FIG. 6) while the other cam lobe 184 enters a relieved area. This moves the control cam 62 axially forward in the recess 188 (see FIG. 6) to disengage the gear 178 from the idler gear 176, and the rotation of the control cam 62 is stopped.

The timing of this action leaves the bolt 56 in a locked position with the breach closed.

In addition, as pointed out above, forward motion of the control cam 62 pushes the propellant fill valve 224 forward, exposing the combustion chamber fill port 228 to the port 222 at the rear of the bore 218 to permit purging of the liquid propellant from the combustion chamber 54. At the same time the water inlet valve 238 is moved forward to open the water injection port 244, and water is purged through the combustion chamber 54 to prevent cook off and to make the round inert.

The control cam disengagement disables that particular gun module but it does not disable the drive cam power train. Therefore, other modules in the banked row or cluster continue to operate and fire. Operation in this limited condition can continue until servicing. Projectiles intended for loading but passing over the disabled module are ejected at the end of the feed system transfer region.

If a projectile is missing at the feed system conveyor, a mechanical interlock system leaves a retainer in the path of the propellant fill valve 224 to prevent the valve from opening. As the module continues in a cycle of operation, a pseudo misfire occurs, and the module is disabled as described above.

Since complete propellant filling depends on fluid pressure in the propellant supply system with the monopropellant injection system described above, insufficient pressure of the propellant supply system could result in incomplete propellant filling. In the present invention when the supply pressure inadvertently drops below an established level, a pressure sensing interlock system (see FIG. 44) stops operation of the complete group (row or cluster of modules).

Figure 31:
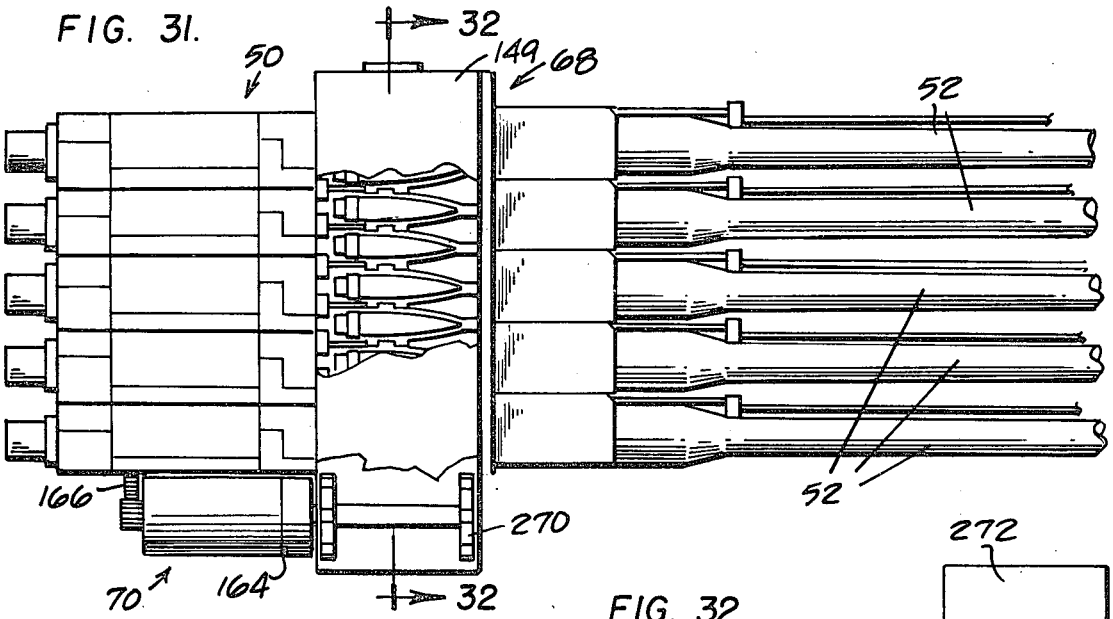
FIG. 31 is a top plan view showing five gun modules assembled in a flat pack cluster together with a drive motor for the gun modules and the projectile feed system.

The projectile feed system is best shown in FIG. 31.

The projectile feed mechanism 68 employs a short endless conveyor 149 which is driven by a sprocket drive 270 from the drive motor 164.

Figure 32:
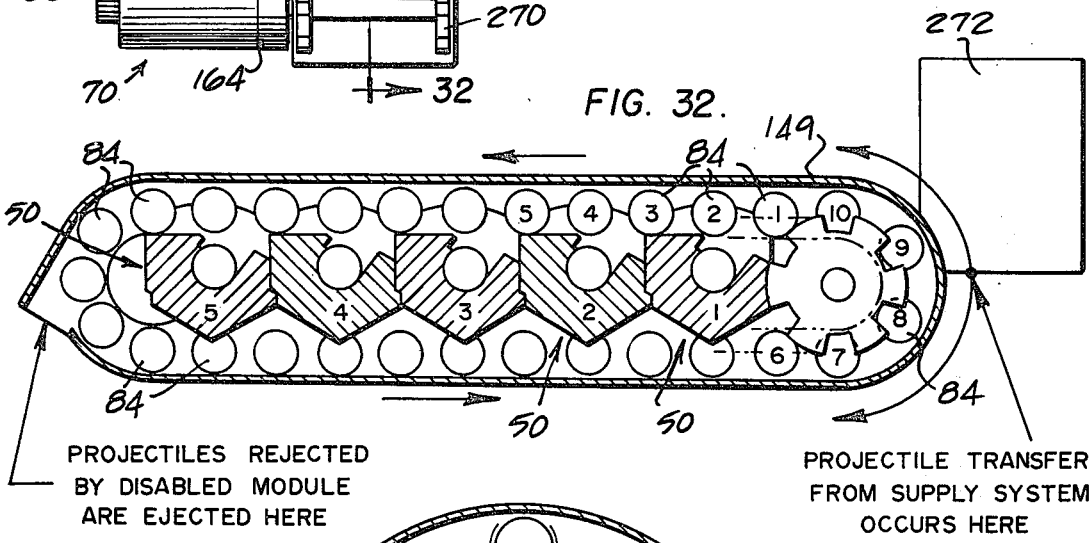
FIG. 32 is an end elevation view taken generally along the line and in the direction indicated by the arrows 32—32 in FIG. 31.

As best illustrated in FIG. 32, the conveyor 140 mates with a transfer mechanism 272 to accept projectiles 84 from a conventional belt or linkless feed. The transfer mechanism 272 includes a shifting device which selects from separate projectile supplies to switch types of ammunition. The spring clip cradles 146 are the primary elements of the conveyor 149. The tangs on the ends of the spring clip cradles slide in guide grooves in the conveyor frame. The cradles are coupled to form an endless, flexible chain.

Figure 33:
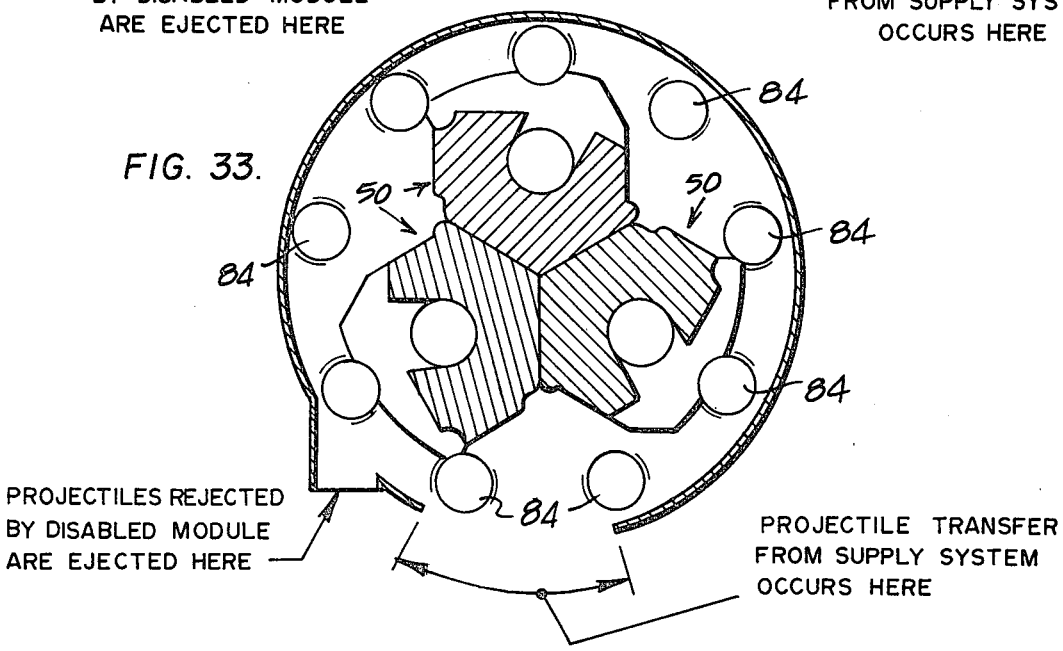
FIG. 33 is an end elevation view like FIG. 32 but showing the projectile feed system for three gun modules assembled in a circular cluster.
Figure 34:
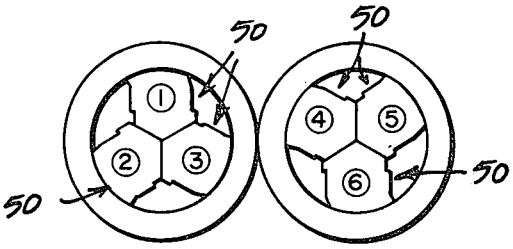
FIGS. 34–39 illustrate different cluster configurations for the modular gun of the present invention and illustrate how projectile feed systems are associated with these different cluster configurations.
Figure 35:
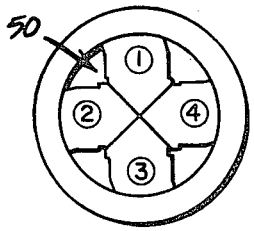
Figure 36:
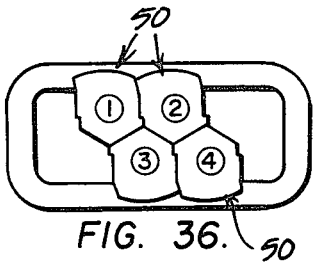
Figure 37:
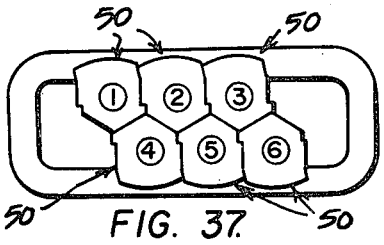
Figure 38:
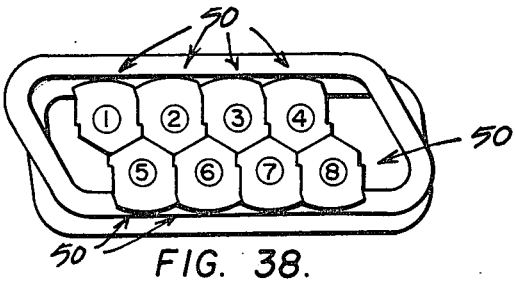
Figure 39:
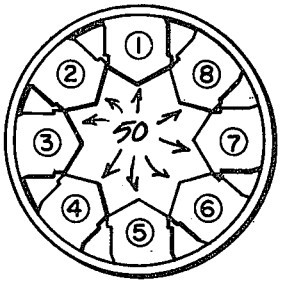

Two configurations of the conveyor 149 are illustrated in FIGS. 31–32 and in FIG. 33. In FIGS. 31 and 32 a flat conveyor passing over a banked row of modules is illustrated and in FIG. 33 a circular conveyor wrapping around a cluster of three modules is illustrated.

The flat conveyor configuration shown in FIGS. 31 and 32 demonstrates the loading scheme of the present invention which depends on a unique sequencing arrangement. In FIG. 32 a banked row of five modules served by the conveyor 149 are indicated by the reference numerals 1–5. The projectiles 84 move along the conveyor from right to left and are numbered in groups of five, e.g. (5, 4, 3, 2, 1) (10, 9, 8, 7, 6), etc. The modules are also numbered (5, 4, 3, 2, 1) and are loaded in the sequence 1 through 5 and fire, of course, in the same sequence. Center-to-center spacing of the projectiles in the conveyor (1.75 in. for 30 mm) is ½ the center—center spacing of the modules (3.5 in. for 30 mm).

Assume projectile 1 is at the loading position for module 1. The loading lever on the module kicks the projectile out of the conveyor and into the module. The conveyor travels 1.75 inches between loadings. Projectile 2 as 1.75 inches away from the loading position for module 2 at the start but has now arrived in position and is loaded. Projectile 3 is now 1.75 inches away from the module 3 and will arrive at the loading position on time. The loading progresses until projectile 5 is loaded in module 5, this projectile having moved 7.0 inches while the other projectiles were loading. By the time projectile 5 has been loaded, projectiles 10, 9, 8, 7 and 6 have moved into positions occupied by projectiles 5, 4, 3, 2 and 1 at the start. The process continues in perfect time, with projectile 6 loading into module 1, projectile 7 loading into module 2, etc. This loading scheme applies to any number of modules.

The circular conveyor for a cluster of three modules, shown in FIG. 33, uses the same loading scheme as described above. Since the conveyor is circular, the cradles can take the form of pockets in a wheel-like structure. A minimum of six cradles or pockets are needed to properly feed the cluster. Nine pockets are shown in FIG. 33 to reduce the rotational speed of the conveyor and the centrifugal force imposed on the projectiles, thus reducing the force that must be exerted by the projectile loading levers at the modules.

Other cluster configurations as illustrated in FIGS. 34–39 are readily arranged and serviced by the projectile loading mechanism 68 as described above.

The modular system of the present invention can accomodate recoil adapters similar to those on the M-61 gun to reduce recoil forces. A banked row or cluster or modules can be supported mutually at the breach end of the barrels by a bracket structure that receives a pair (or more) of recoil adapters. An additional bracket structure mutually supports the rear of the modules and engages a short fixed slide to accomodate recoil travel. The latter bracket includes a provision for boresighting.

Figure 41:
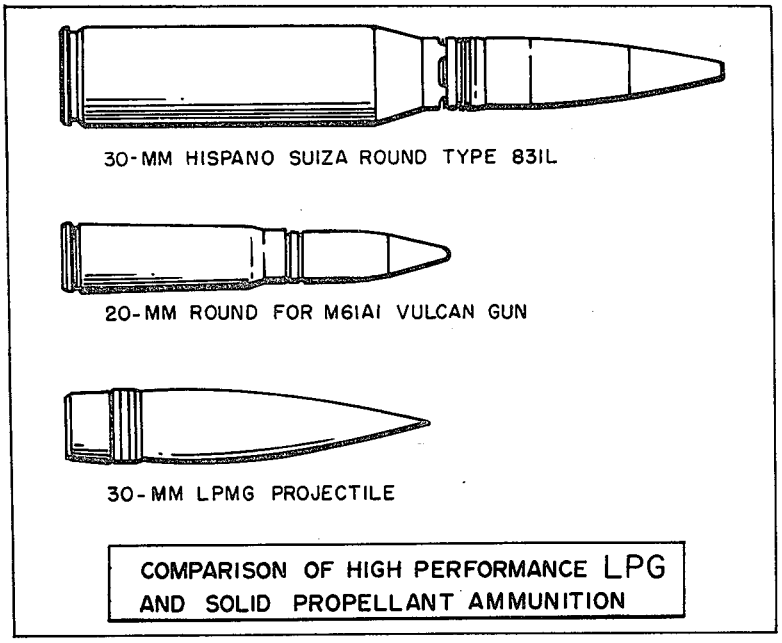
FIG. 41 is a top plan view showing a size comparison of a 30 mm liquid propellant projectile, a conventional solid propellant 20 mm round of an M61 Vulcan gun and a conventional solid propellant round for a 30 mm Hispan Suiza round type 831L.

The impact of caseless operation on gun design is best illustrated in FIG. 41 which compares a 30 mm liquid propellant modular gun projectile with a conventional 20 mm round for the M-61 gun. Due to the similarity in length and diameter between the liquid propellant projectile and the solid propellant round, it is feasible to directly substitute the 30 mm projectile for the existing 20 mm cartridge. Some modifications are, of course, required due to slight differences in configuration but the overall volume is substantially the same.

Figure 40:
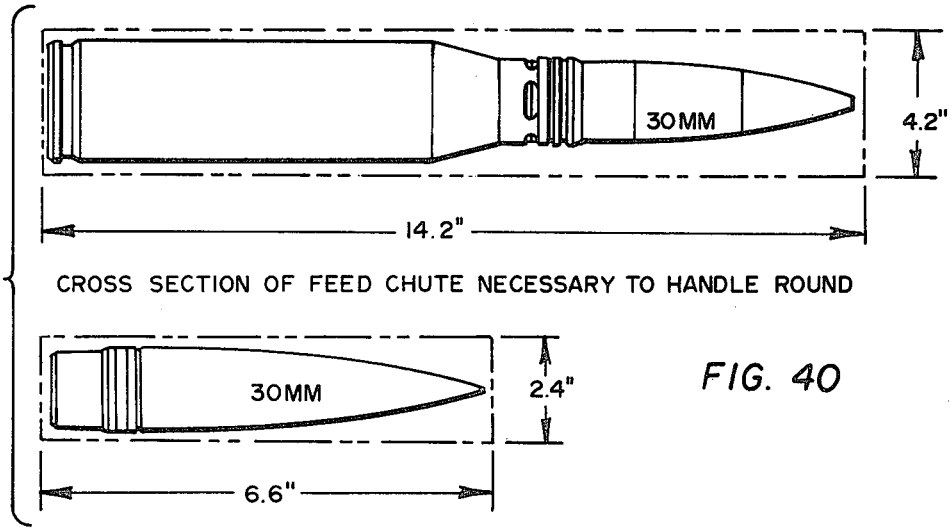
FIG. 40 is a plan view showing a size comparison for high performance 30 mm liquid and solid propellant rounds of ammunition and also illustrates the relative feed chute sizes required.

FIG. 40 compares the diameters of a liquid propellant modular gun projectile in a 30 mm size with the cartridge and projectile size for a conventional 30 mm solid propellant round. This figure graphically illustrates the space and weight savings which can be achieved for the projectile feed systems in the 30 mm gun size with the liquid propellant modular gun of the present invention.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

We claim:

1. A drive cam for reciprocating a bolt back and forth between a rearward, projectile loading position and a forward, projectile firing position in a gun, said drive cam comprising, a hollow cylindrical member having a longitudinal axis disposed parallel to the axis of reciprocation of the bolt and mounted for rotation about said longitudinal axis, a first spiral cam track formed on the inside of the hollow cylindrical member and engageable with a cam follower on the bolt to drive the bolt forward, and a second spiral cam track separate from the first spiral cam track and formed on the interior of the hollow cylindrical member and engageable with the cam follower of the bolt to drive the bolt rearward and wherein the hollow cylindrical member includes dwell area means at the front and rear for permitting rotation of the hollow cylindrical member without producing axial movement of the bolt.

2. The invention defined in claim 1 including gear teeth on the outer periphery of the hollow cylindrical member at one end of the hollow cylindrical member for engagement with a driving gear.

3. A drive cam for reciprocating a bolt back and forth between a rearward, projectile loading position and a forward, projectile firing position in a gun, said drive cam comprising, a hollow cylindrical member having a longitudinal axis disposed parallel to the axis of reciprocation of the bolt and mounted for rotation about said longitudinal axis, a first spiral cam track formed on the inside of the hollow cylindrical member and engageable with a cam follower on the bolt to drive the bolt forward, a second spiral cam track formed on the interior of the hollow cylindrical member and engageable with the cam follower of the bolt to drive the bolt rearward, and including a bolt mounted for reciprocation within the interior of the hollow cylindrical member, said bolt having a radially projecting cam follower at one end of the bolt and mounted for sliding movement radially inward and radially outward of the bolt, and biasing means for biasing the cam follower radially outward of the bolt.

4. The invention defined in claim 3 wherein the hollow cylindrical member includes dwell area means at the front and rear for permitting rotation of the hollow cylindrical member without producing axial movement of the bolt and wherein the forward dwell area means includes a radially extending slot having sidewalls engageable with the cam follower for rotating the bolt to a locked position.

5. The invention defined in claim 4 including receiver cam means associated with the forward dwell area means and cam follower for moving the cam follower radially inward of the bolt and out of engagement with the sidewalls of the slot after the bolt has been rotated to the locked position.

* * * * *

UNITED STATES PATENT OFFICE

CERTIFICATE OF CORRECTION

Patent No. 4,164,890 Dated August 21, 1979

Inventor(s) Lester C. Elmore et al

It is certified that error appears in the above-identified patent and that said Letters Patent are hereby corrected as shown below:

Column 2, line 46, "or single" should read --of single--.

Column 5, line 50-51, "cam follower in" should read --cam follower 64 in--

Column 6, line 34, "of an" should read --for an--.

Column 8, line 21, "zone" should read --cone--.

Column 9, line 6, "misfire. in" should read --misfire. In--; line 54, "0.8 1 turn" should read --0.8 turn--.

Column 10, line 4, "22 an 23" should read --22 and 23--.

Column 13, line 48, "Q=124,000" should read --Q=125,000--.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*